US005113382A

United States Patent [19]

Bron

[11] Patent Number: 5,113,382

[45] Date of Patent: May 12, 1992

[54] CHRONOGRAPH WATCH

[75] Inventor: Alphonse Bron, Bassecourt, Switzerland

[73] Assignee: Eta SA Fabriques d'Ebauches, Granges, Switzerland

[21] Appl. No.: 684,780

[22] Filed: Apr. 15, 1991

[30] Foreign Application Priority Data

Apr. 12, 1990 [CH] Switzerland ..... 1261/90

[51] Int. Cl.[5] ..... G04F 7/00; G04F 8/00

[52] U.S. Cl. ..... 368/106; 368/113

[58] Field of Search ..... 368/101-113, 368/185, 190-199

[56] References Cited

U.S. PATENT DOCUMENTS 2,158,506 5/1939 McLelland et al. ..... 368/112
4,445,783 5/1984 Dodanc ..... 368/106

FOREIGN PATENT DOCUMENTS 436356 3/1912 France .
0322511 7/1989 France .
548061 4/1974 Switzerland .

*Primary Examiner*—Vit W. Miska
*Attorney, Agent, or Firm*—Weil, Gotshal & Manges

[57] ABSTRACT

A chronograph watch provided with a control arrangement for the three functions of start, stop and reset to zero. The purpose of the invention is to provide a more judicious distribution of the elements of the chronograph mechanism over the entire surface of the watch. This purpose is attained by means of a watch characterized in that it comprises a start and stop cam (48) and a reset-to-zero cam, both of these cams being constituted by superposed concentric rings arranged at the periphery of the watch movement, in that both of these cams (48, 49) exhibit respectively ratchet teeth (97) or notches (98*a*, 98*b*) on their outer periphery on which act two levers (100, 101) to drive the cams (48, 49) in rotation and teeth (96) or notches (99) on their inner periphery acting on the control levers for the gearing forming the chronograph mechanism.

8 Claims, 13 Drawing Sheets

Prior art 106
49
48
12H
104

CHRONOGRAPH WATCH

This invention concerns a chronograph watch provided with a control arrangement for the three standard functions of a chronograph, i.e. start, stop and reset to zero.

BACKGROUND OF THE INVENTION

In the majority of standard chronographs, such three functions are controlled through a column wheel. As shown on FIG. 1, such column wheel 1 is a rotatable element comprising triangular teeth 2 in its lower portion, and columns 3 in its upper portion. When one exerts pressure on the end 4 of the large lever 5, the latter pivots in the sense of arrow F and by its other end drives said column wheel in rotation thanks to the triangular teeth 2 of the latter. When such column wheel turns, it drives and displaces on one hand the end of the hammer 6 which releases heart piece 7 of the center wheel 8 and, on the other hand, the intermediate lever 9 which acts on the intermediate wheel 10 by bringing this latter into contact with the center wheel 8 in order to mesh with the latter. One thus obtains the starting of the chronograph. Upon a second pressure being exerted at 4, the beak of brake 11 which up to now remained in its initial position, being held by column 3*a*, swings between the two neighbouring columns 3*a* and 3*b* and its rounded portion 12 moves to block the center wheel 8. One thus obtains the stop function of the chronograph. Finally, a third pressure exerted on the large lever 5 brings about the reset to zero since the intermediate wheel 10 is released and hammer 6 is brought to bear on the heart piece 7 in order to bring wheel 8 back to zero.

It may be determined from FIG. 1 that the column wheel shown by way of example includes six columns and eighteen teeth. It is thus necessary to exert pressure on the large lever 5 three times in order that a column take the place of the preceding column, which corresponds to the three functions of the chronograph.

The utilization of a column wheel complicates the construction of the chronograph and requires that the ends of the hammers and levers assuring the control of the functions are concentrated at a single point. There are already known chronographs provided with arrangements aiming to suppress the column wheel and to simplify the construction.

To this end, Swiss patent CH-466 152 describes a chronograph comprising a first lever operated at one end by a start push-button and at the other end by a second stop push-button and a second lever operated by a third reset- to-zero push-button.

In the same manner, Swiss patent CH-579 794 describes a chronograph in which the column wheel is replaced by a cam at three levels effecting the three chronograph functions.

Nevertheless, these arrangements do not enable a more judicious distribution of the elements of the mechanism over the entire surface of the watch.

Consequently, the purpose of this invention is to overcome these difficulties.

SUMMARY OF THE INVENTION

To this end, the invention has as its object a chronograph watch comprising a chronograph mechanism comprising a first push-button controlling the starting and the stopping of the chronograph and acting on a start-and-stop lever, and a second push-button controlling the reset to zero of the chronograph and acting on a reset-to-zero lever.

In conformity with the invention, such watch comprises a start and stop cam and a reset-to-zero cam, such two cams being constituted by two superposed concentric rings arranged at the periphery of the watch movement Such two cams exhibit respectively on their outer periphery triangular ratchet teeth or notches on which act the two levers for driving such cams in rotation and both cams additionally exhibit on their inner periphery teeth or notches acting on control levers for the gearing constituting the chronograph mechanism.

Thanks to these annular control cams, it is possible to distribute the control levers, i.e. the hammers and levers over the entire surface of the watch movement in a manner such that their ends come into contact with the internal periphery of the annular cams. It is thus no longer necessary to concentrate the control levers at a single point as has been the case with a column wheel.

Furthermore, should repairs be necessary to the chronograph, access to the parts is facilitated.

The invention will be better understood upon reading the following description of a preferred embodiment thereof, given by way of non-limiting example and from the attached drawings.

DESCRIPTION OF THE PREFERRED EMBODIMENT

In the description to follow, the terms 3 o'clock, 6 o'clock, 9 o'clock, 12 o'clock, high, low, upper, lower are employed having reference to a chronograph seen from the top, that is to say, from the dial side.

Figure 1:
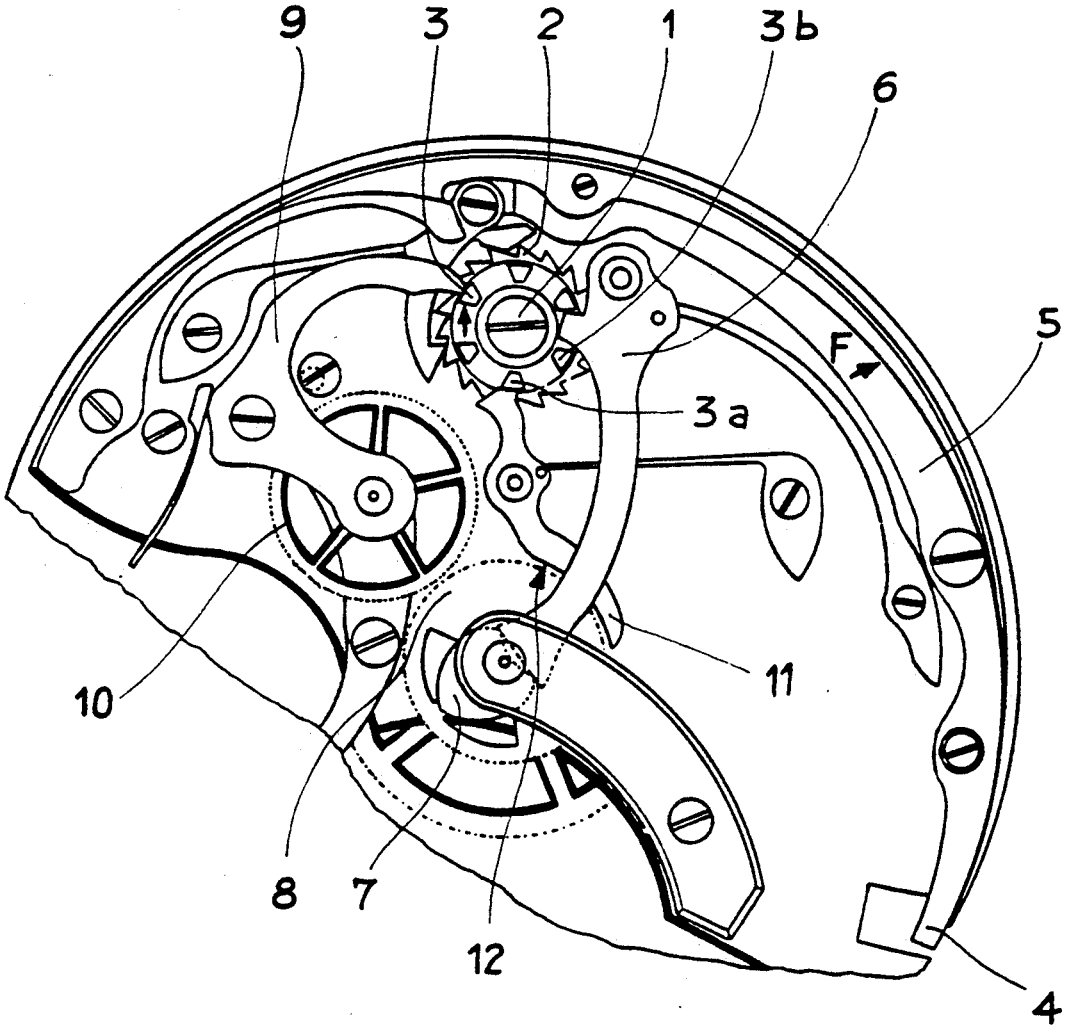
FIG. 1 shows a top view of a standard chronograph provided with a wheel controlling the three chronograph functions.
Figure 2:
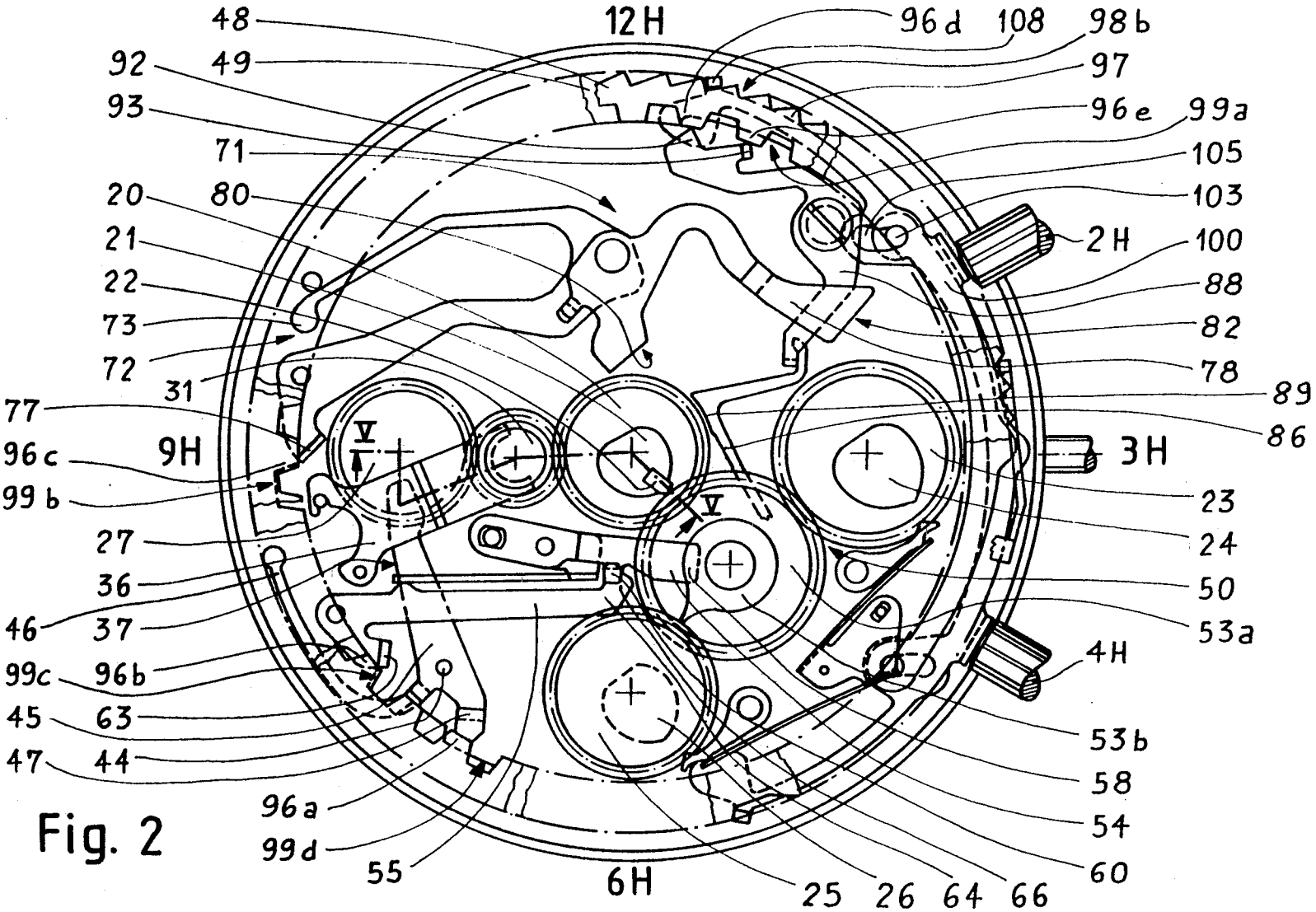
FIGS. 2, 3 and 4 show top views of the chronograph watch according to the invention, respectively in its start, stop and reset-to-zero positions.
Figure 3:
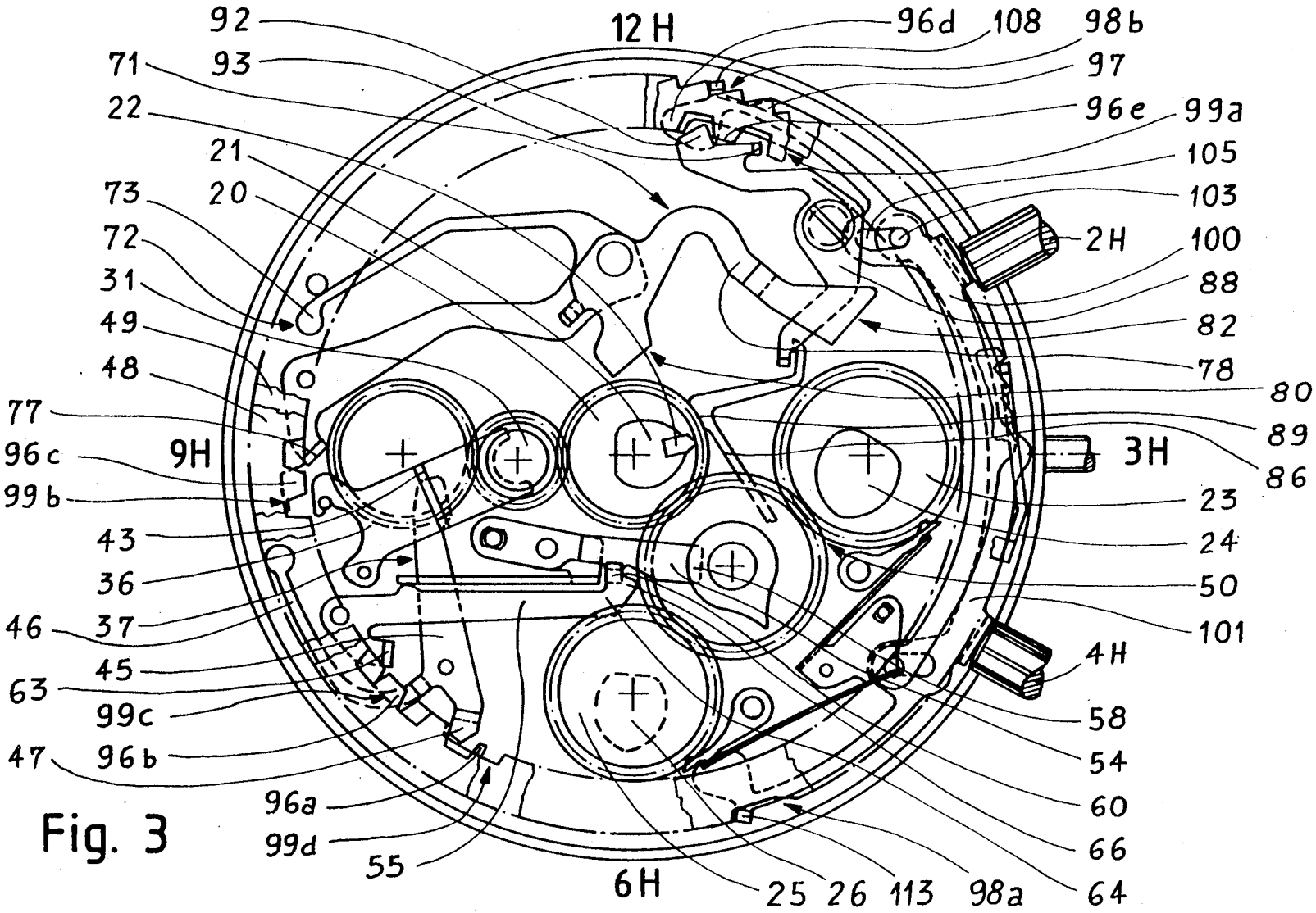
Figure 4:
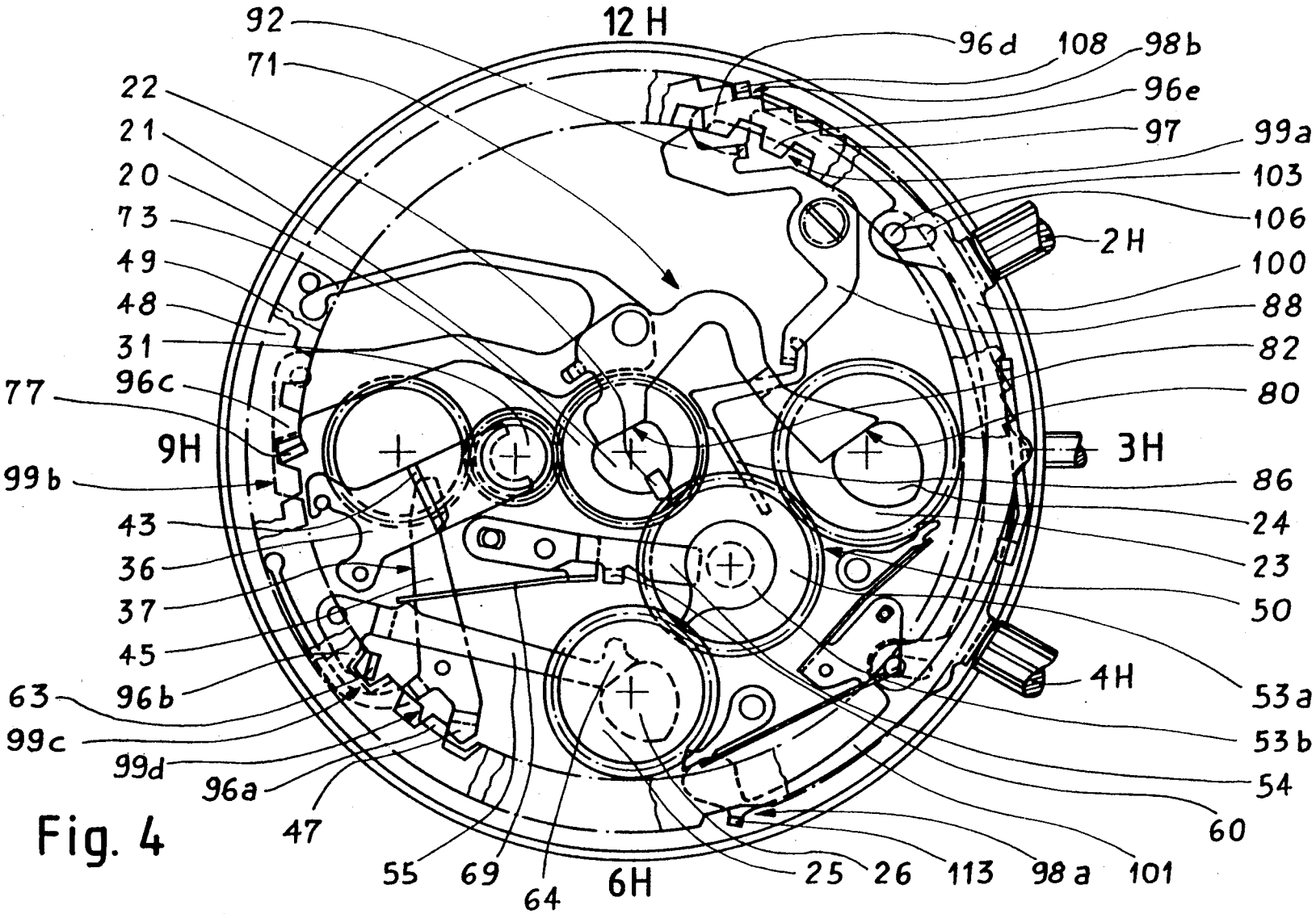
Figure 11:
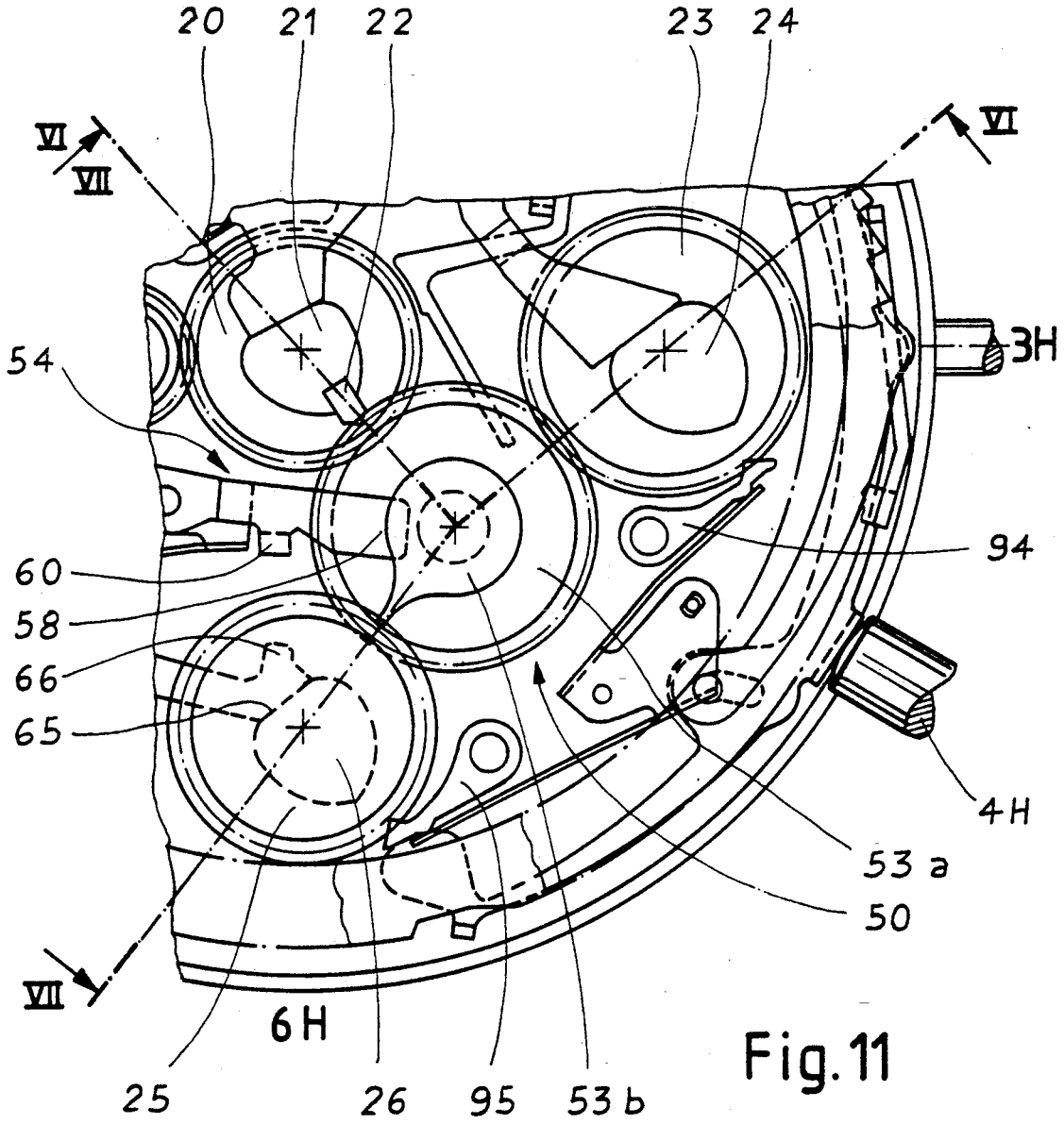
FIGS. 11, 12, 13 and 14 are enlarged detail views of FIG. 4 showing parts of the chronograph.

As shown on FIGS. 2, 3 and 4 and more particularly on FIG. 11, the chronograph comprises in a standard manner, a chronograph wheel 20 provided with a heart piece 21 and a driving finger 22 in its center and, on its periphery, respectively at 3 o'clock and at 6 o'clock, a minutes counter wheel 23 provided with a heart piece 24 and an hours counter wheel 25 provided with a heart piece 26. In order to simplify the figure, the hands of these various counters and the chronograph seconds hand have not been shown. As appears better on FIGS.

6 and 7, the heart piece 21 is arranged on the chronograph wheel 20 and the driving finger 22, which extends vertically, is arranged above the heart piece 21. The heart piece 24 is arranged on the minutes counter wheel 23 while the heart piece 26 is on the contrary arranged below the hours counter 25.

Figure 12:
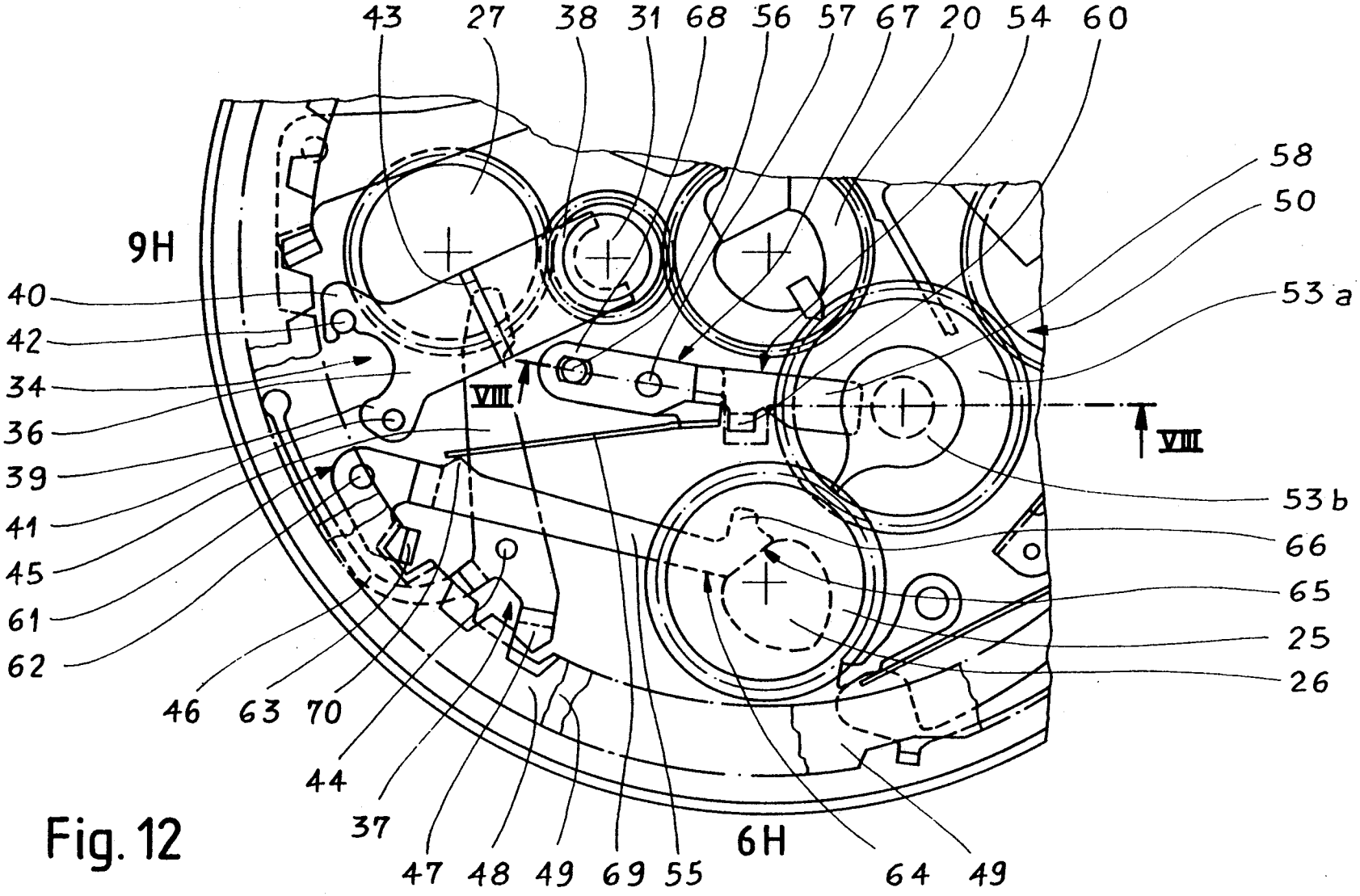

The watch does not include a center seconds display, the real time seconds display being obtained from an off-center graduation at 9 o'clock provided on the dial via a small seconds wheel 27 (FIG. 12).

Figure 5A:
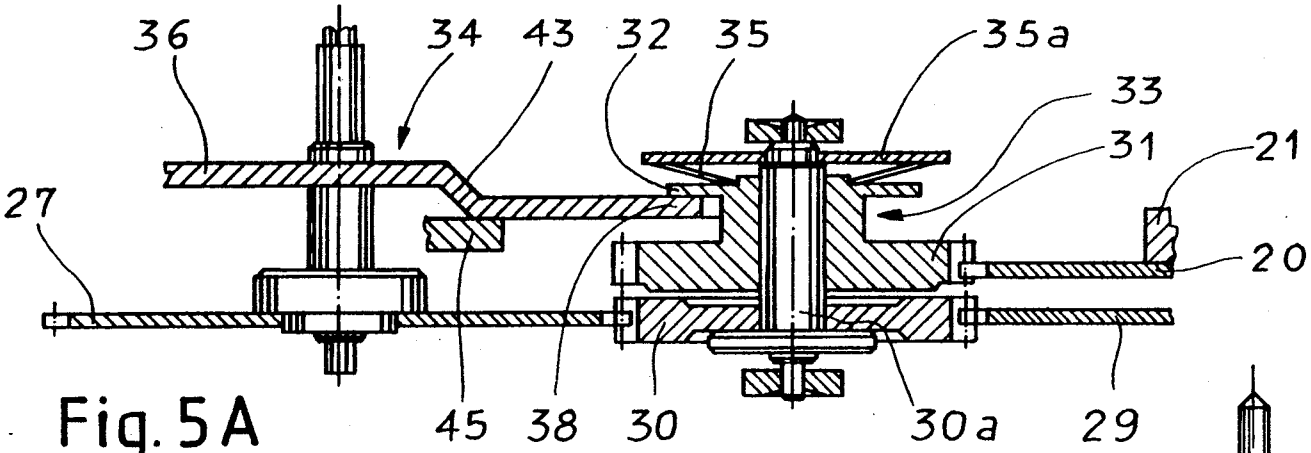
FIGS. 5 and 5A are cross-sections along line V—V of FIG. 2 showing two end positions which can be assumed by a clutch wheel.
Figure 5:
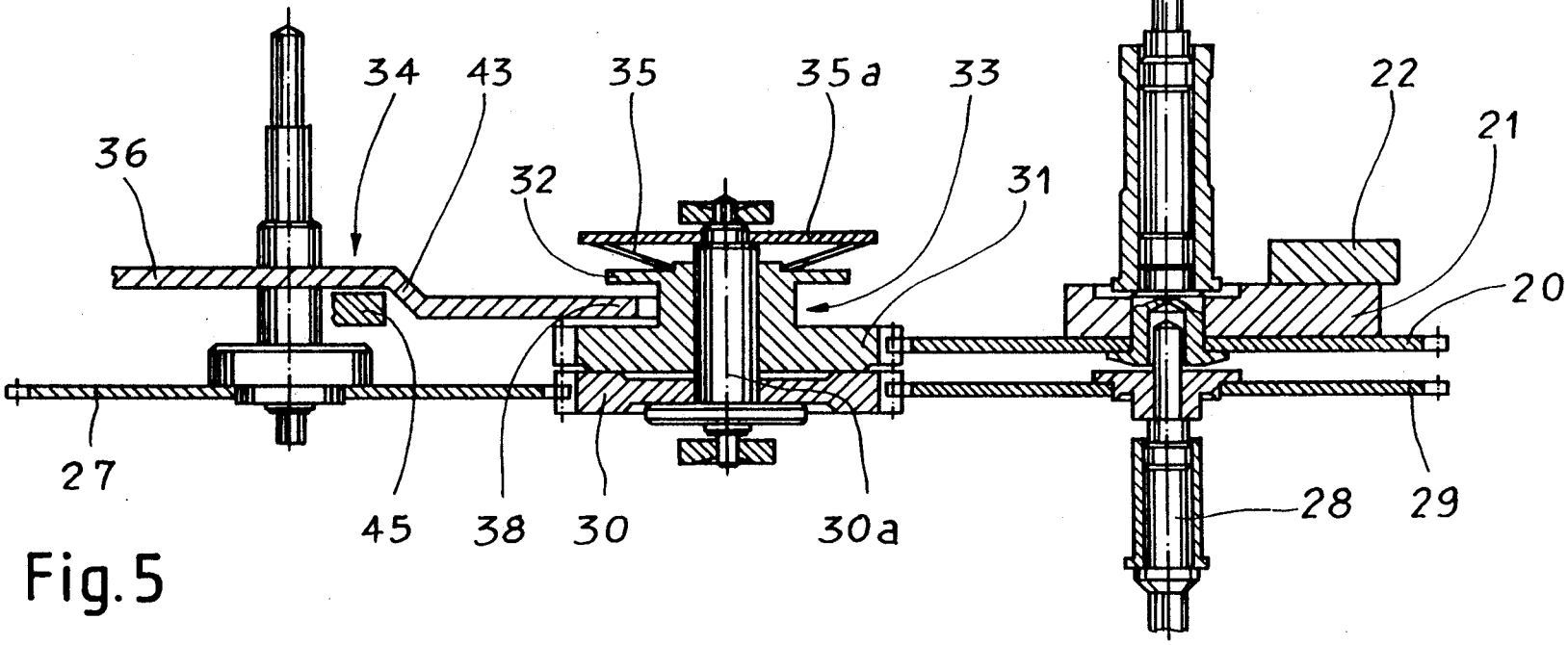

As may be seen on FIG. 5, such small seconds wheel 27 is driven from the seconds arbor 28 by a supplementary gear 29 and an intermediate seconds wheel 30 rotating freely around an arbor 30*a*. The supplementary gear 29 is directly secured onto the seconds arbor 28 below the chronograph wheel 20. When the watch is in operation, wheels 29, 30 and 27 rotate for instance at the rate of one step per second in the case of a quartz watch, in order to display real time.

The wheels and the heart pieces of the watch according to the invention are employed in a standard manner for chronograph timepieces and a person skilled in the art will readily be able to form and assemble them without the necessity of further description.

Furthermore, above the intermediate seconds wheel 30 and in a manner coaxial to the latter, there is arranged a clutch wheel 31 adapted to slide along the arbour 30*a* in order to assume two positions, an engaged position (lower position shown on FIG. 5), in which it comes into contact with the wheel 30 which drives it in rotation by friction and in which it meshes with the chronograph wheel 20, and the disengaged position, (upper position shown on figure 5A) in which it is no longer in contact with the intermediate seconds wheel 30, but in which it continues to mesh with wheel 20. Consequently, wheel 20 rotates at the same speed as wheel 30 when the clutch wheel 31 is in the engaged position.

Such clutch wheel 31 is surmounted by a collar 32 slightly spaced from wheel 31 and defining with the latter an engagement groove 33 for the clutch control 34 which will be subsequently described. Finally, this clutch wheel 31 is maintained in contact with the wheel 30 by an elastic washer 35 fastened onto a plate 35*a* driven onto the arbor 30*a*, such washer exercising pressure on the collar 32 in the engaging sense of wheels 31 and 32.

Such clutch wheel 31 is operated by the clutch control 34 formed from two pieces 36 and 37 cooperating with one another (see FIG. 12).

Piece 36 is an arm of substantially rectangular form and exhibits at one of its ends a fork 38 and at its other end two feet 39 and 40. Piece 36 is positioned by two studs 41 and 42 and maintained by a bridge which is not shown.

In addition, arm 36 exhibits in its central position an inclined plane 43. On FIG. 5, one sees that the fork 38 penetrates in the engagement groove 33 and permits raising the clutch wheel 31 thanks to the collar 32. In the disengaged position (FIG. 5*a*), wheel 31 undergoes the counteraction of washer 35. In its engaged position (FIG. 5), arm 36 is substantially free around studs 41, 42.

Part 37 is a lever which may be swung around a pivot 44 and comprising three branches extending from such pivot 44, a clutch branch 45 the end of which acts directly on the inclined plane 43, an elastic branch 46 acting as a spring and coming to bear against the watch base plate, and a control branch 47 coming into contact with the two control cams 48, 49 which will be described subsequently. The clutch branch 45 and the branch acting as a spring 46 form a U adapted to be opened and closed by spreading apart or bringing together the two branches 45 and 46, i.e. in bending more or less the branch 46 acting as a spring.

Thus, if a force directed towards the interior is exerted on the control branch 47, as is the case in FIG. 2, lever 37 and the clutch branch 45 turn about pivot 44 towards the exterior of the watch movement against spring 46. On the contrary, when the control arm 47 is released (see FIG. 3), spring 46 tends to displace lever 37 in the opposite sense, which effects rotation of the clutch branch 45 towards the center of the watch, and the latter coming into contact with the inclined plane 43, lifts slightly arm 36, this having as effect to disengage the clutch wheel 31. Thus, on FIGS. 5 and 5*a*, it will be understood that the branch 45 is displaced towards the right, this having as effect to lift the fork 38 thanks to the inclined plane 43, and to disengage wheel 31.

As may be seen on FIGS. 2, 6, 7 and 11, between wheel 23 of the minutes counter, wheel 25 of the hours counter and the chronograph wheel 20, there is arranged a slider assembly 50 comprising an arbor 51 pivotally mounted in bearings 51*a*, 51*b* with a certain axial clearance, a hub 52 driven onto such arbor 51 and showing annular shoulders at its ends on which are supported on the one hand a sliding gear 53*a* and on the other hand a driving finger 53*b*. Further, the hub 52 exhibits an annular undercut 53*c* which together with the drive gear 53*a* bounds a groove the function of which will be specified subsequently (see FIGS. 6 and 7).

Figure 6:
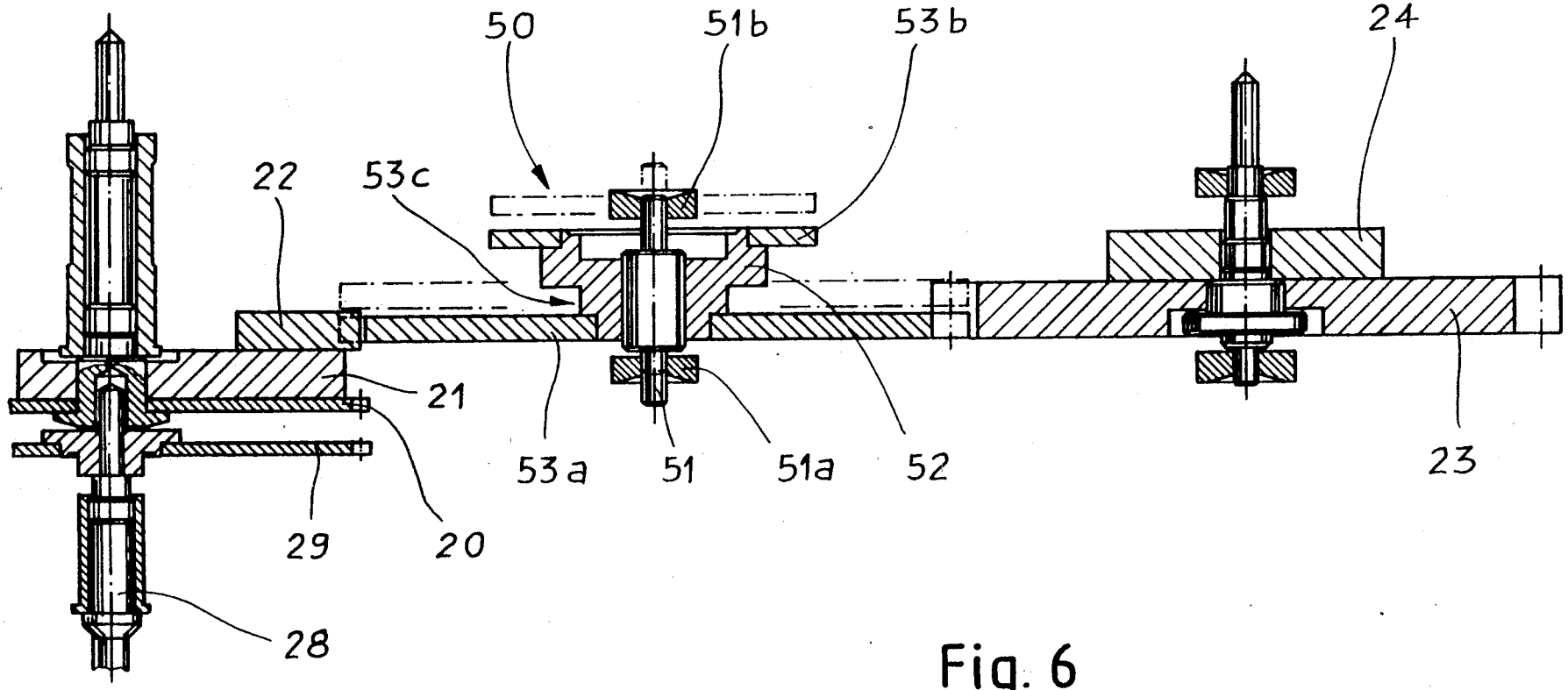
FIG. 6 is a cross-section along line VI—VI of FIG. 11.
Figure 7:
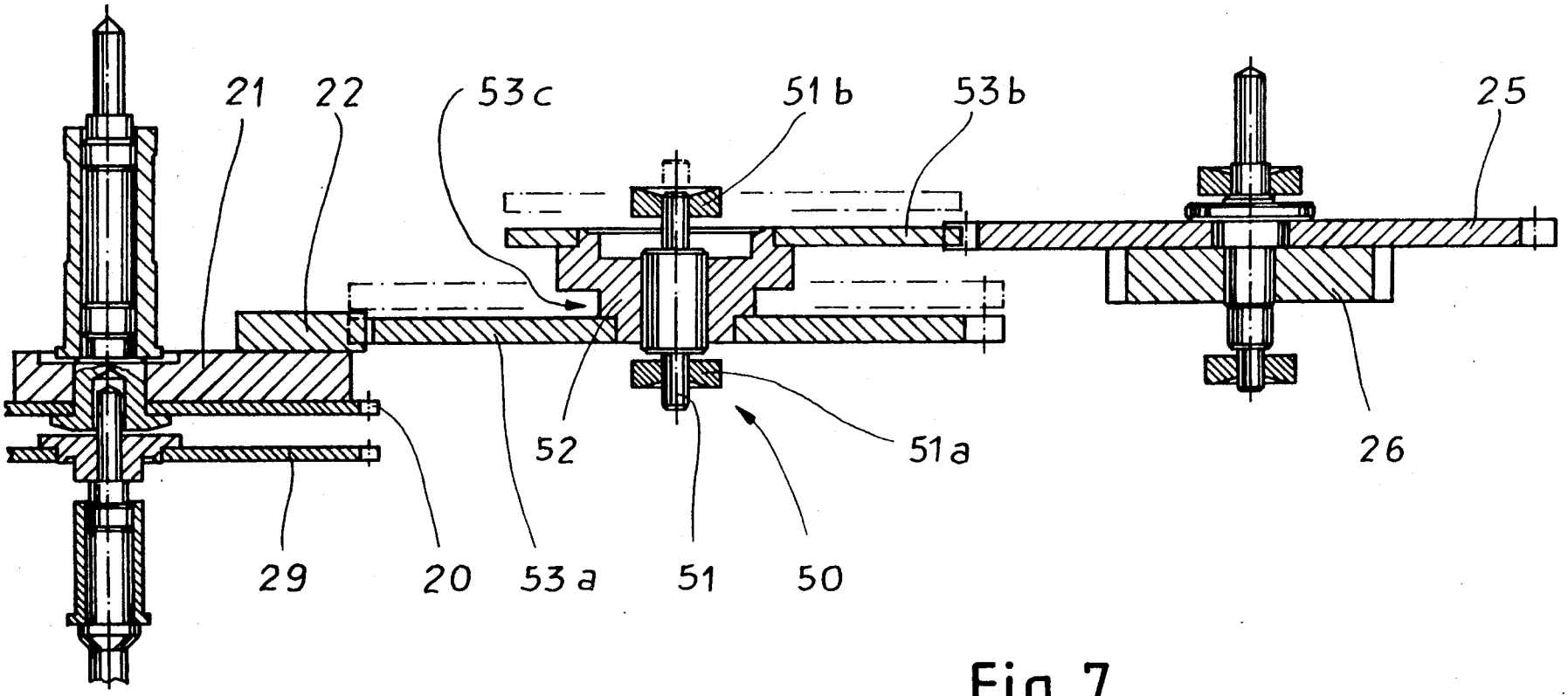
FIG. 7 a cross-section along line VII—VII of FIG. 11.

In a manner quite similar to that which has been previously described for the clutch wheel 31 and as shown on FIGS. 6 and 7, such sliding gear 53*a* may assume two positions, on the one hand a disengaged position (high position shown by a dash-dot outline) in which gear 53*a* does not mesh with the driving finger 22 of the chronograph heart piece 20, and in which the driving finger 53*b* does not mesh with the hours counter wheel 25 and on the other hand an engaged position (lower position, shown in full outline) in which gear 53*a* meshes with the driving finger 22 and in which the driving finger 53*b* meshes with the hours counter wheel 25. One will observe that in the two respective positions, engaged and disengaged, of the slider assembly, gear 53*a* meshes permanently with wheel 23 of the minutes counter (see FIG. 6).

Figure 8A:
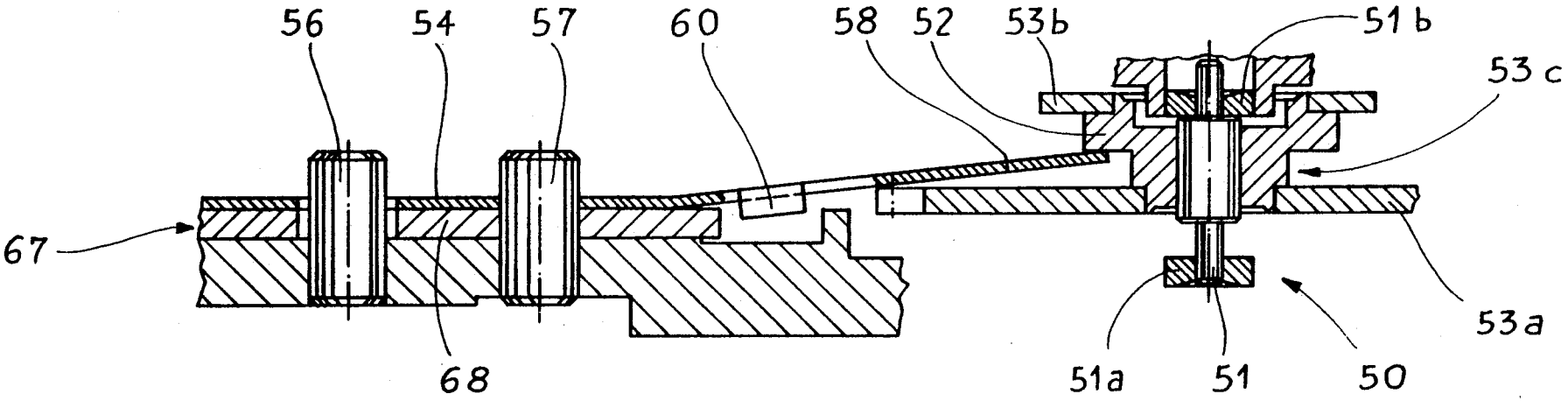
FIGS. 8 and 8A are a cross-section along line VIII—VIII of FIG. 12.
Figure 8:
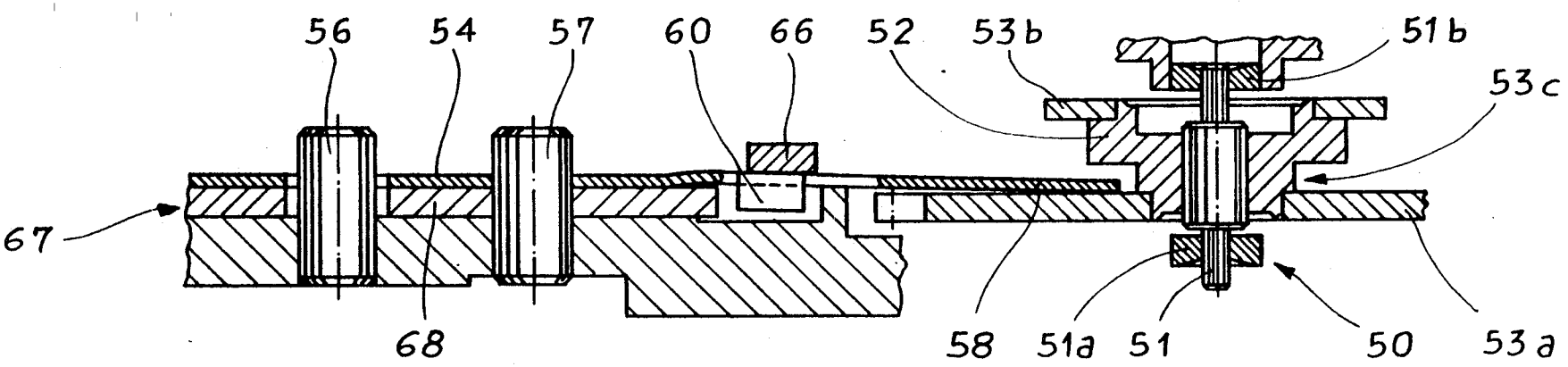

As shown on FIGS. 8, 11 and 12, slider assembly 50 is operated by a control lever 54, itself shifted by the hours counter hammer 55.

Such control lever 54 is an elastic blade maintained by one of its ends on the base plate by means of two studs 56, 57. Its other end 58 is engaged in the groove 53*c* in order to permit lowering the assembly against the natural elasticity of the blade. Additionally, blade 54 includes on its edge directed towards 6 o'clock an inclined plane 60 directed downwardly and towards 6 o'clock in order to cooperate with hammer 55.

Hammer 55 comprises a lever articulated at one of its ends 61 about a pivot 62 (see FIG. 12). Such end 61 also exhibits a beak 63 acting in combination with the control cams 48, 49 which will be subsequently described. The other end of the lever shows a hammer head 64. Such head 64 comprises an inclined part 65 adapted to cooperate with the heart piece 26 of the hours counter 25 and a control foot 66 adapted to cooperate with the inclined plane 60 of the control lever 54.

In addition, a spring plate 67 is arranged under the control lever 54 in order to urge hammer 55 of the hours counter against heart piece 26. Such plate comprises a portion 68 also maintained by studs 56 and 57 and is laterally extended by a spring blade 69. The free end of such spring blade 69 bears on a boss 70 of the hammer 55 for the hours counter 25.

Beak 63 operates to effect pivoting of hammer 55 towards a first position shown on FIGS. 2 and 3 in which the control foot 66 of the hammer head 64 passes over the inclined plane 60 and bears on the upper surface of the control lever 54, this having as effect to lower the end 58 of the control lever 54 and thus also to place slider assembly 50 into mesh with counters 23 and 25 and the driving finger 22 of the chronograph wheel 20. In a second position shown on FIG. 4, the hammer head 64 bears on the heart piece 26 of the hours counter 25. In such second position, lever 54 is upwardly bent by its own elasticity and lifts the slider assembly 50. The spring 69 of plate 67 furthermore maintains hammer 55 in this second position. Such hammer 55 enables the reset to zero of the hours counter 25. These two positions are also shown on FIGS. 8 and 8A.

Figure 13:
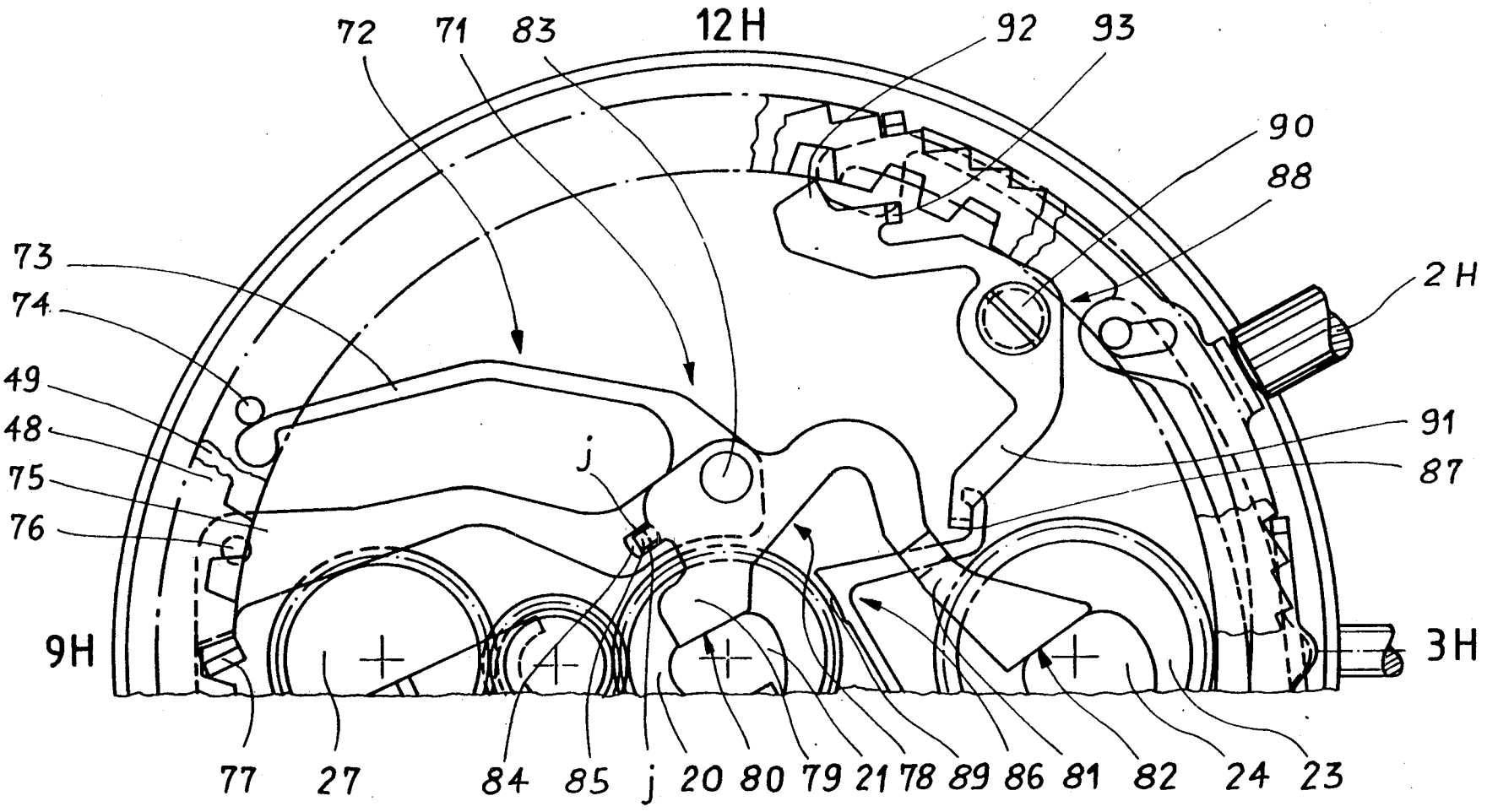

In a similar manner, the chronograph wheel 20 and the minutes counter 23 are brought back to zero via their respective heart pieces 21 and 24 on which a chronograph hammer 71 acts (see FIG. 13).

Such chronograph hammer 71 comprises an assembly of two pieces. The first piece 72 shows two branches arranged in V, one branch forming a spring, the end of which is supported against an abutment 74 placed at the periphery of the movement, and a control branch 75 the free end of which is articulated around a pivot 76 and exhibits a beak 77. The second piece 78 also has two branches, a short branch 79 terminated by an inclined portion 80 adapted to cooperate with the heart piece 21 of the chronograph wheel 20 and a long branch 81 terminated by an inclined portion 82 adapted to cooperate with the heart piece 24 of the minutes counter. The second piece 78 is assembled above the first 72 by a rivet 83 on which it is mounted in rotation. Furthermore, piece 72 shows an oblong orifice 84 while piece 78 comprises a beak 85 vertically directed downwardly, such beak being introduced into the oblong orifice 84 when the two pieces 72 and 78 are assembled. Beak 85 has a width less than that of the oblong orifice 84 in a manner to provide a slight lateral play j between pieces 72 and 78 which provides them with a small angular clearance relative to one another.

The chronograph hammer 71 may assume two positions. In the first position shown on FIG. 4, the inclined portions 80 and 82 bear respectively on heart pieces 24 and 21 under the action of spring 73. On FIG. 4, which corresponds to the rest position, this occurs on the flattened portion of the heart pieces while it occurs on the curved profile during the reset to zero of the chronograph. In the second position shown on FIGS. 2 and 3, the chronograph hammer 71 is separated from heart pieces 21 and 24 straining to a greater extent the branch forming spring 73. The slight lateral play j between the two pieces 72 and 78 enables the two inclined portions 80 and 82 to be respectively in contact with the heart pieces when hammer 71 rests against heart pieces 21 and 24 which would not necessarily be the case if hammer 71 were formed from a single piece.

During operation of the chronograph, wheel 20 rotates and when it is desired to pass to the stop function, one can block such chronograph wheel 20 via a brake lever 86 (FIG. 13). Such brake lever 86 shows a V form one branch of which has a curved-back end 87 which engages directly with the control lever 88 for brake lever 86 and the other branch of which is substantially rectilinear and shows on its side face a braking surface 89 which may come into contact with the chronograph wheel 20 and block it. The control lever 88 is pivoted substantially at its mid portion about an axis 90 and exhibits an elbowed control arm 91 acting on the end 87 of the brake lever 86 and a second arm exhibiting at its free end a forward beak 92 and a back beak 93.

These two beaks are operated by the control cams 48, 49 the operation of which will be subsequently described in a manner to cause the control lever 88 to pivot and thence the brake lever 86.

Furthermore, the minutes counter 23 and the hours counter 25 are respectively positioned by jumpers 94 and 95. Their structures being standard, further detailed description will not be given (see FIG. 11).

Figure 9:
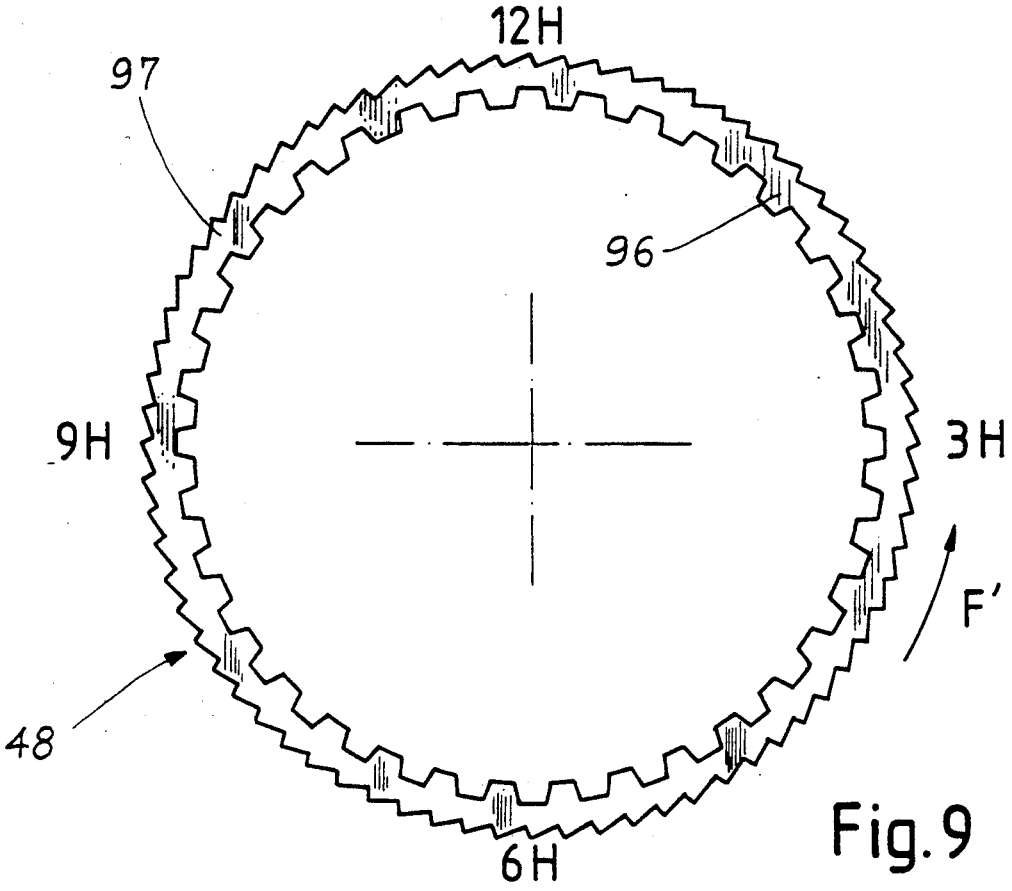
FIGS. 9 and 10 are top views respectively of the start-and-stop cam and of the reset-to-zero cam in accordance with the invention.
Figure 10:
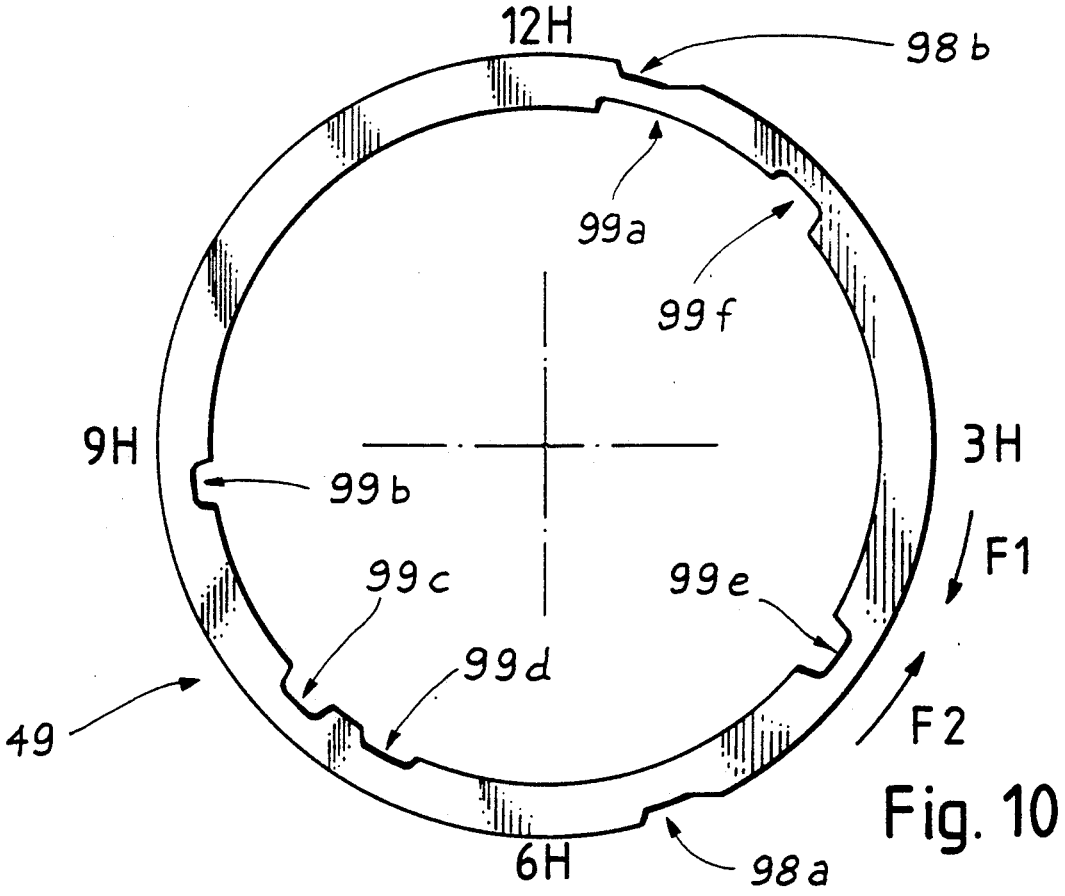

The control arrangement of the three chronograph functions according to the invention comprises in particular the start-and-stop cam 48 and the reset-to-zero cam 49. For better understanding such cams have been separately shown on FIGS. 9 and 10. They are constituted by two concentric rings guided on their peripheries and superposed, cam 49 being arranged below cam 48 (see FIGS. 2, 3 and 4). Such cams are guided by a milled-out portion (not shown) provided in the base plate of the movement as is the date disc in a standard watch movement.

The chronograph cam 48 is movable in a unidirectional manner in a counter-clockwise sense (arrow F'). It shows over its entire internal periphery a series of identical trapezoidal teeth 96 and over its entire outer periphery a series of identical triangular ratchet teeth 97. For a better understanding of the operation of the chronograph certain of such teeth 96 and 97 have been identified by letter indices on FIGS. 2, 3 and 4.

Figures 14, 14A, 14B:
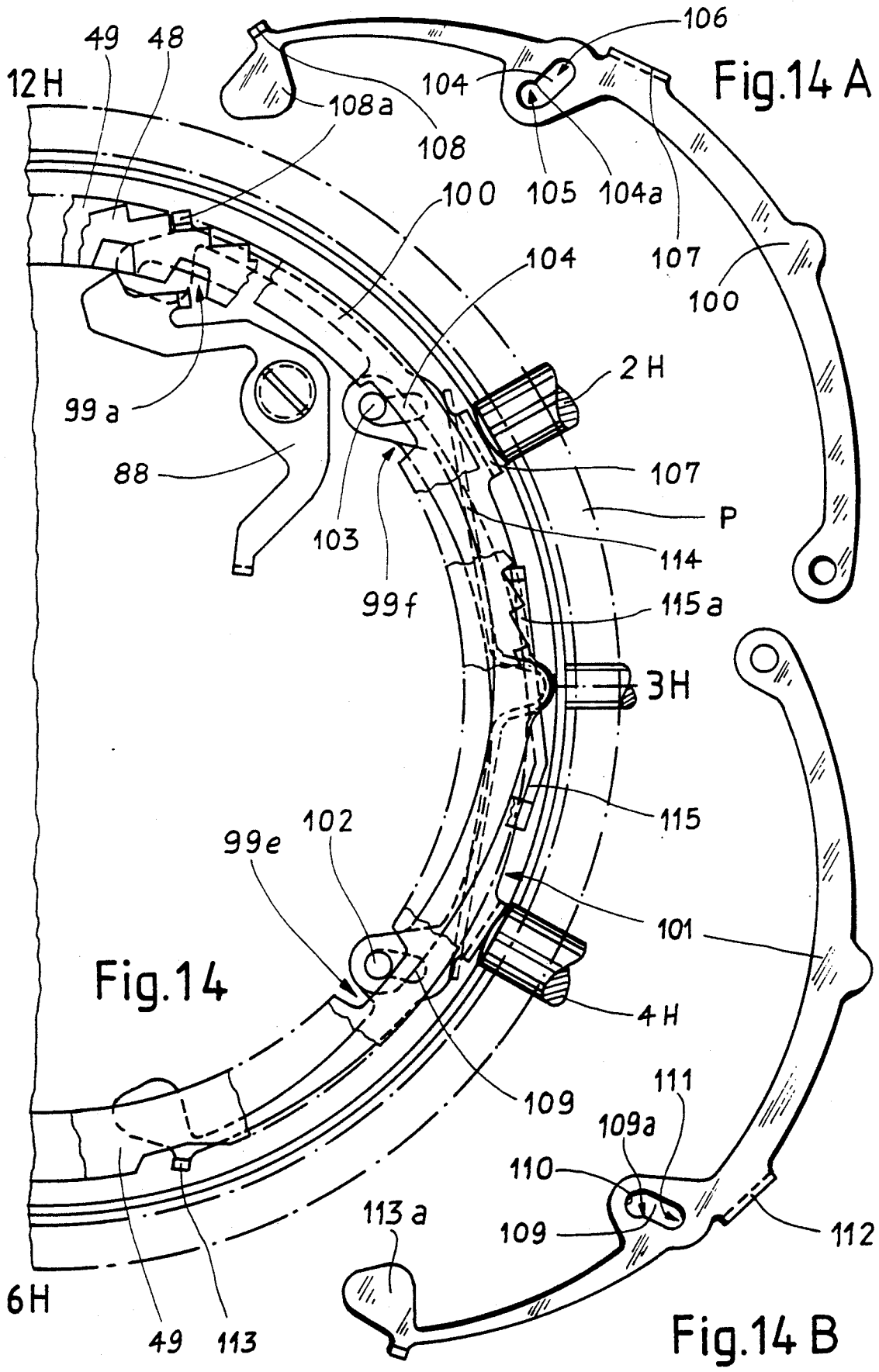
FIGS. 14A and 14B show respectively the start-and-stop lever and the reset-to-zero lever as taken out of FIG. 14.

The reset-to-zero cam 49 may be displaced in a bidirectional manner by a single step either in the clockwise sense (arrow F1) or in the counterclockwise sense (arrow F2). It shows on its outer periphery substantially at 5:30 o'clock a notch 98*a* and (substantially at 0:30 o'clock) a notch 98*b*. On its internal periphery there is provided a clearance 99*a* extending from the position of the outer notch 98*b* and an internal notch 99*f* provided at 2 o'clock. Further internal notches 99*b*, 99*c*, 99*d* and 99*e* are respectively provided at 9 o'clock, between 7 and 8 o'clock, at 7 o'clock and at 4 o'clock. As illustrated on FIGS. 14, 14A and 14B, cams 48 and 49 are operated by a start-and-stop lever 100 and by a reset-to-zero lever 101, both having an almost identical form. The start-and-stop lever 100 is movable at one end around a pivot 102 while the reset-to-zero lever 101 is movable at one of its ends about a pivot 103. The start-and-stop lever 100 comprises an opening 104 in the form of a bean which defines three special positions of the lever, namely a rest position in which pivot 103 is in contact with the rounded inner end of the opening, an unstable position in which the same pivot 103 is in contact with the other rounded outer end 106 of the opening, and an intermediate cross-over position from a hard point defined by the side edge of the opening 104 which to this end defines a catch 104*a*.

Furthermore, such lever 100 comprises on its outer surface close to opening 104 a blade or pallet 107 bent at a right angle on which may act a push-button 2H arranged substantially at 2 o'clock. Additionally, at its free end, it is provided towards the exterior with a beak 108 and towards the interior with a guide head 108*a* which slides on a support which is not shown and which guides beak 108 parallel to cams 48, 49. Lever 100 being arranged below the two cams 48 and 49, such beak 108 which is upwardly directed is sufficiently long to permit displacing both cams by half a step counterclockwise, each time that push-button 2H is pressed.

In a similar manner, the reset-to-zero lever 101 comprises an opening 109 with a catch 109*a* and two rounded portions 110 and 111, a pallet blade 112, a beak 113 and a guide head 113*a*. Such lever is operated by a push-button 4H which is positioned substantially at 4 o'clock. Beak 113 acts only on the reset-to-zero cam 49.

The reset-to-zero lever 101 is arranged below the stop-and-start lever 110, but head to tail relative to the latter in a manner such that pivot 103, around which such lever 101 pivots, goes through the opening 104 of lever 100 and likewise oppositely. Thus, pivot 102, around which the lever 100 pivots, goes through the opening 109 of lever 101.

Furthermore, it will be noted that notches 99*f* and 99*e* enable the reset-to-zero cam 49 to be displaced backward and forward without being hindered by the respective pivots 103 and 102, while limiting its displacement to a single step. A spring wire 114 bears with both branches against levers 100 and 101 in order to bring them, as well as the push-buttons 2H and 4H, to their rest position, the spring wire being supported on the interior wall of the base plate P of the watch (solely visible on FIG. 14) in which the present movement is mounted.

Finally, a jumper spring 115 secured in the base plate of the movement includes an operating foot 115*a* at its free end in order to cooperate with the backs of the outer teeth 97 of cam 48.

The operation of the chronograph which has just been described will now be examined.

During a cycle of operation of the chronograph, cam 48 makes one step of one tooth 96 in the sense of arrow F'.

Such movement is effected in two half-steps, namely a half-step in order to go from the rest position (FIG. 4) to the operating position (FIG. 2) and a half-step to go from the operating position (FIG. 2) to the stop position (FIG. 3). In order to facilitate the description, there has been indicated by reference 96 coupled with a letter index the teeth which are active during the movement from the rest position shown on FIG. 4, it being understood that the letter indices correspond respectively to one operation of the corresponding tooth on beak 47 (96*a*), the beak 63 (tooth 96*b*), the beak 77 (tooth 96*c*), the beak 92 (96*d*) and the beak 93 (tooth 96*e*) of the different organs controlled by the cam.

As is well understood, after going through a cycle, it is respectively the teeth following those indicated which will act in order to bring about the following cycle. It is to be noted that each half-step of cam 48 corresponds to the passage of one triangular tooth 97 on the outer periphery of such cam 48.

Starting the Chronograph

Starting is obtained when the user exerts a pressure on the push-button 2H. The chronograph elements which were found in the position shown on FIG. 4 go to the position shown on FIG. 2.

The user exerts a pressure on push-button 2H, this having as effect to cause stop-and-start lever 100 to pivot in a manner such that the rounded portion 105 is disengaged from the pivot 103, the rounded portion 106 coming to bear thereon. The catch 104*a* then forces the crossing over of the hard point which is felt by the user. The beak 108 of this lever pushes the chronograph cam 48 and the reset-to-zero cam 49 by half-a-step in the sense F', F2, in acting on one of the triangular teeth 97 and on the notch 98*b*. The tooth 96*a* of the chronograph cam 48 pushes the control branch 47 of lever 37. Branch 45 frees arm 36 which is lowered in order to come to the position shown on FIG. 5. The clutch wheel 31 which initially was raised comes into contact with the intermediate seconds wheel 30. Such clutch wheel 31 then drives the chronograph wheel 20 and the chronograph hand (not shown).

Tooth 96*b* of cam 48 and the face of notch 99*c* of cam 49 simultaneously raise beak 63 of the hammer 55, this having as effect to cause such hammer to pivot and to free the hours counter 25. At the end of its travel, hammer 55 presses on the inclined plane 60 of the control lever 54, this having as effect to lower the slider assembly 50 and to bring wheel 53*a* of the slider assembly 50 to the height of the driving finger 22 of chronograph wheel 20. Simultaneously, the drive finger 53*b* is placed at the height of the hours counter wheel 25. Thus, both counters are simultaneously driven, the operating force being provided via arbor 28 and the supplementary wheel 29 belonging to the timekeeping mechanism for real time operation of the movement. When the chronograph wheel 20 has effected one rotation, its drive finger 22 causes the slider assembly 50 to advance by one step, this having as effect to cause the advance by one step of the minutes counter 23. At the end of 30 minutes, slider assembly 50 has effected one complete rotation and caused hours counter 25 to advance one step.

Simultaneously, tooth 96*c* of cam 48 and the face of notch 99*b* of cam 49 push beak 77 of the chronograph hammer 71. This enables separating the inclined portions 80 and 82 of the heart pieces 21 and 24 and freeing the chronograph wheel 20 and the minutes counter 23.

During this movement, teeth 96*d* and 96*e* of cam 48 are naturally also displaced through half a step, but they cannot act on lever 88 for brake 86 since the forward beak 92 thereof is maintained towards the interior by the high surface formed by the internal periphery of cam 49, up until the moment when tooth 96*e* of cam 48 raises beak 93 of lever 88. There results therefrom that the brake 86 remains separated from the chronograph wheel 20.

It is evident that all the operations which have just been described are brought about almost simultaneously.

Stopping of the Chronograph

Here again, the operations which are to be described, take place substantially simultaneously. The chronograph is in the operating position shown on FIG. 2. When the user exerts a second pressure on push-button 2H, the chronograph elements will be displaced and come to the position shown on FIG. 3. The start-and-stop lever 100 was brought to its initial position (FIG. 4) following the first pressure on button 2H thanks to the spring wire 114 solely shown on FIG. 14. This wire 114 must be sufficiently hard to overcome the resistance against return of lever 100 by catch 104*a*, and in order that beak 108 passes above the top of tooth 97 which precedes that which it has just pushed back, so as to be ready to act once again on cam 48. Additionally, cam 48 is retained by jumper spring 115 during the return of the stop-and start lever Under the action of push-button 2H, the stop-and-start lever 100 is displaced as in the preceding case in order that beak 108 bring about the advance of a half step in the sense F' of cam 48 only. Cam 49 does not rotate since it possesses only one notch 98*b* and has already been displaced during the starting of the chronograph. The forward beak 92 of the control lever 88 for brake 86 falls between teeth 96*d* and 96*e* of cam 48 and in the clearance 99*a* of cam 49. The back beak 93 of control lever 88 for brake 86 falls in the space between the tooth 96*e* and the following tooth on cam 48. This has as effect to bring about pivoting of the control lever 88 for brake 86 and to bring the brake surface 89 of the latter into contact with the chronograph wheel 20, thus blocking the latter. Effectively, even if the chronograph wheel 20 is no longer driven as is explained below, it is important to block it in order not to risk losing the indication of the elapsed time by an untimely displacement of such wheel 20. The displacement of tooth 96*c* of cam 48 does not affect the chronograph hammer 71 since the latter is always maintained by cam 49 in the position of FIG. 2. For similar reasons, hammer 55 does not move.

The control branch 47 of lever 37 falls in the space between tooth 96*a* and the following tooth of cam 48 and also into the notch 99*d* of cam 49. The arm 36 is operated and lifts the clutch wheel 31 in separating it from the intermediate seconds wheel 30. The chronograph wheel 20 is thus no longer driven It will be noted that notch 99*d* is provided only as a clearance in order not to bring about an eventual hindering of the movement of branch 47.

Reset to Zero of the Chronograph

During this operation, the chronograph elements pass from the position of FIG. 3 to that of FIG. 4.

The reset to zero is obtained by a pressure exerted on the push-button 4H which acts on the reset-to-zero lever 101. This latter brings about a rotational movement identical to that already described with reference to lever 100, in acting however uniquely on cam 49 through its beak 113. The latter bears on the face of notch 98*a* of said cam. This rotates through a half step in the clockwise sense (F1) and effects the following functions in the order mentioned hereinbelow.

The face of the clearance 99*a* of cam 49 raises the forward beak 92 of lever 88 which in turn displaces brake 86 thus freeing the chronograph wheel 20.

The beak 63 of the hours counter hammer 55 falls into the notch 99*c* of cam 49 and frees the clutch lever 54 which raises the slider assembly 50 The latter is thus disengaged from the driving finger 52 of the chronograph wheel 20 and the hours counter wheel 25. Next, the hammer head 64 falls on the heart piece 26 which returns towards its initial position of zero. In a similar manner, beak 77 of the chronograph hammer 71 falls into the notch 99*b* of cam 49 and inclined portions 80 and 82 cause the heart piece 24 and the heart piece 21 to rotate to the point of bringing the minutes counter into its initial position as well as the hand of the chronograph wheel.

The return to zero of the moving elements is brought about by the force of the hammer springs (spring 69 for the hours counter 25 and spring 73 for the minutes counter 23 and the chronograph wheel 20).

It is to be noted that notch 99*d* of cam 49 is sufficiently wide in order that the latter may not act on beak 47 during the reset to zero.

What I claim is:

1. A chronograph watch having a chronograph mechanism comprising gears, a first push button controlling the starting and stopping of the chronograph and acting on a start and stop lever, a second push button controlling the reset to zero of the chronograph and acting on a reset-to-zero lever, a start and stop cam and a reset-to-zero cam, both such cams being constituted by superposed concentric rings arranged at the periphery of the watch movement, both such cams respectively exhibiting ratchet teeth or notches on their outer periphery on which act two levers to drive such cams in rotation, and both such cams respectively exhibiting teeth or notches on their inner periphery acting on control levers for the gearing constituting the chronograph mechanism.

2. A chronograph watch as set forth in claim 1 wherein the start and stop cam exhibits ratchet teeth over its entire outer periphery on which a beak arranged on the start and stop lever acts in order to displace said cam in a unidirectional manner.

3. A chronograph watch as set forth in claim 1 wherein the reset-to-zero cam exhibits a first notch on its outer periphery on which the beak arranged on the start and stop lever acts, in order to displace said cam by one step in one sense, and a second notch on which a beak arranged on the reset-to-zero lever acts in order to displace said cam by one step in the opposite sense.

4. A chronograph watch as set forth in claim 1 wherein from the top towards the bottom of the watch there are successively superposed the start and stop cam, the reset-to-zero cam, the start and stop lever and the reset-to-zero lever, the beak of the start and stop lever being upwardly directed and sufficiently long to act simultaneously on the ratchet teeth of the start and stop cam and on the notch of the reset-to-zero cam and the beak of the reset-to-zero lever being likewise upwardly directed but acting only on the notch of the reset-to-zero cam.

5. A chronograph watch as set forth in claim 1 further comprising a chronograph wheel provided with a reset-to-zero heart piece and a driving finger, a minutes-counter wheel provided with a heart piece and an hours-counter wheel provided with a heart piece, a sliding gear adapted to mesh simultaneously with the chronograph wheel, the minutes-counter wheel and the hours-counter wheel and operated by a control lever a clutch wheel adapted to mesh with the chronograph wheel and simultaneously connect with an intermediate wheel driven from the seconds arbor of the watch, such wheel being operated by a clutch control a brake lever for the chronograph wheel operated by a brake control lever an hours-counter hammer for resetting the hours-counter wheel to zero, such hammer also operating the control lever and a chronograph hammer for resetting to zero the chronograph wheel and the minutes-counter wheel, the reset-to-zero cam having an undercut (99*a*) on its inner periphery cooperating with the brake control lever, a notch (99*b*) cooperating with the chronograph hammer and a notch (99*c*) cooperating with the hours-counter hammer, and the start and stop cam also exhibiting teeth identical to one another over its entire inner periphery and cooperating with the control lever, the chronograph hammer, the hours-counter hammer and the clutch control.

6. A chronograph watch as set forth in claim 2 further comprising a jumper spring arranged at the periphery of the start and stop cam and cooperating with the ratchet teeth thereof in order to prevent rotation of said cam in the sense opposite to that of its normal rotation sense

7. A chronograph watch as set forth in claim 5 wherein the first push button is arranged substantially at two o'clock, the second push button is arranged substantially at four o'clock, the chronograph wheel the minutes-counter wheel and the hours-counter wheel are substantially arranged respectively at the center, at three o'clock and at six o'clock and the notches 99*a*, 99*b*, 99*c*), of the reset-to-zero cam are substantially arranged respectively between 0 and 1 o'clock, 9 o'clock and between 7 and 8 o'clock.

8. A chronograph watch as set forth in claim 1 wherein the start and stop lever pivots at one end around a first pivot and comprises a first bean-shaped opening defining a catch and two rounded portions the reset-to-zero lever pivots at one end around a second pivot and comprises a second bean-shaped opening defining a second catch and two rounded portions, the first pivot passing through the second opening and the second pivot passing through the first opening in a manner to limit the respective angular displacement of the reset-to-zero lever and the start and stop lever.

* * * * *